US009999564B2

(12) United States Patent
Ishiguro et al.

(10) Patent No.: US 9,999,564 B2
(45) Date of Patent: Jun. 19, 2018

(54) BACK MASSAGING APPARATUS

(71) Applicant: DAITO ELECTRIC MACHINE INDUSTRY COMPANY LIMITED, Higashi-Osaka-shi, Osaka (JP)

(72) Inventors: Fumitaka Ishiguro, Higashi-Osaka (JP); Ken Tamaki, Higashi-Osaka (JP); Shinsaku Shimizu, Higashi-Osaka (JP)

(73) Assignee: DAITO ELECTRIC MACHINE INDUSTRY COMPANY LIMITED, Higashi-Osaka-Shi, Osaka (JP)

( * ) Notice: Subject to any disclaimer, the term of this patent is extended or adjusted under 35 U.S.C. 154(b) by 679 days.

(21) Appl. No.: 14/422,840

(22) PCT Filed: Oct. 15, 2013

(86) PCT No.: PCT/JP2013/077974
§ 371 (c)(1),
(2) Date: Feb. 20, 2015

(87) PCT Pub. No.: WO2014/103477
PCT Pub. Date: Jul. 3, 2014

(65) Prior Publication Data

US 2015/0231023 A1 Aug. 20, 2015

(30) Foreign Application Priority Data

Dec. 25, 2012 (JP) ..... P2012-280520

(51) Int. Cl.
*A61H 15/00* (2006.01)

(52) U.S. Cl.
CPC . *A61H 15/0078* (2013.01); *A61H 2201/1669* (2013.01)

(58) Field of Classification Search
CPC ..... A61H 7/00; A61H 7/001; A61H 7/004; A61H 7/007; A61H 2007/009; A61H 15/0078
See application file for complete search history.

(56) References Cited

U.S. PATENT DOCUMENTS 6,224,563 B1 * 5/2001 Nonoue ..... A61H 15/0078 601/100
2002/0082534 A1 * 6/2002 Jikiba ..... A61H 15/0078 601/99

(Continued)

FOREIGN PATENT DOCUMENTS

CN 1989921 A 7/2007
CN 102149360 A 8/2011

(Continued)

OTHER PUBLICATIONS

International Search Report, issued in PCT/JP2013/077974, dated Dec. 3, 2013.

*Primary Examiner* — Justine Yu
*Assistant Examiner* — Kathrynn Lyddane
(74) *Attorney, Agent, or Firm* — Birch, Stewart, Kolasch & Birch, LLP

(57) ABSTRACT

In a back massaging apparatus capable of projecting a massaging mechanism forward and returning the same to an original normal position, a motion amount is to be sufficient. The back massaging apparatus provided in a chair-type massaging machine includes: a massaging mechanism having: left and right paired massaging members each of which is provided with a treatment unit performing a massaging operation; and a drive unit transmitting a massaging operation to the massaging members; and a projection amount variable mechanism which moves the massaging members so that a projection amount of the treatment unit in the back and forth direction is varied.

6 Claims, 10 Drawing Sheets

(56) References Cited

U.S. PATENT DOCUMENTS

| | | | | |
|---|---|---|---|---|
| 2003/0216673 | A1* | 11/2003 | Miki | A61H 15/00 601/99 |
| 2004/0024335 | A1* | 2/2004 | Marcantoni | A61H 15/0078 601/99 |
| 2004/0171972 | A1* | 9/2004 | Shimizu | A61H 15/00 601/99 |
| 2005/0090770 | A1* | 4/2005 | Chen | A61H 15/0078 601/99 |
| 2008/0234613 | A1* | 9/2008 | Schefthaler | A61H 15/0078 601/100 |
| 2011/0275968 | A1* | 11/2011 | Liu | A61H 7/007 601/134 |
| 2014/0024983 | A1* | 1/2014 | Numata | A61H 7/007 601/99 |

FOREIGN PATENT DOCUMENTS

| | | | |
|---|---|---|---|
| CN | 102231973 | A | 11/2011 |
| JP | 7-16277 | A | 1/1995 |
| JP | 2006-34636 | A | 2/2006 |
| JP | 2010-252905 | A | 11/2010 |
| JP | 2012-165852 | A | 9/2012 |
| TW | 201233383 | A | 8/2012 |

* cited by examiner

BACK MASSAGING APPARATUS

TECHNICAL FIELD

The present invention relates to a back massaging apparatus massaging a back of a user and relates to a back massaging apparatus appropriately used for such as a chair-type massaging machine.

BACKGROUND ART

As to a chair-type massaging machine, there is well-known one that is equipped with a massaging mechanism inside a backrest part thereof, performing a massaging operation of a pair of left and right massaging members.

Since this massaging mechanism is necessarily moved along a spine of a user sitting on a seat part, a vertical movement mechanism is installed and a back massaging apparatus is configured of this massaging mechanism and the vertical movement mechanism. As a back massaging apparatus of this type, there is proposed one that is provided with an extrusion/retraction operating mechanism for projecting the massaging members forward a usual massaging position and returning back the same to the original usual position (for example, see Patent Literature 1).

In this extrusion/retraction operating mechanism, a based member which is vertically moved within a backrest part by the vertical movement mechanism is provided separately from the massaging mechanism and the massaging mechanism is supported to this base member so that an upper end side thereof is swung back and forth via a lower pivot. And a slider elevating by a feed screw mechanism with its shaft core oriented in a lengthwise direction is provided on the base member mentioned above, and coupling between this slider and the upper end portion of the massaging mechanism is made by a transmission arm.

That is, in a case where the slider on the base member is raised, the upper end portion of the massaging mechanism is pushed forward via the transmission arm, resulting in that the upper end side of the massaging mechanism is swung forward with the lower pivot as a fulcrum, and therefore the left and right massaging members are rendered to be projected forward.

CITATION LIST

Patent Literature

Patent Literature 1: Japanese Unexamined Patent Publication JP-A2010-252905

SUMMARY OF INVENTION

Technical Problem

In the chair-type massaging machine with a back massaging apparatus disclosed in Patent Literature 1, since the massaging members can be projected forward and returned to the original usual position by actuating an extrusion/retraction operating mechanism, a feeling of satisfaction of a user to a massage has been sufficiently enhanced.

However, since this extrusion/retraction operating mechanism is provided with an arcuate rail part for guiding the upper end portion of the transmission arm forward at the time of vertically moving the slider, a swing regulation mechanism regulating an inclination of each massaging member and the like, the back massaging apparatus has a tendency to be large-sized in the back and forth direction (thickness) thereof (see FIGS. 1 and 2 of Patent Literature 1, etc.).

In consideration of the above situation, the present invention has been made and an object thereof is to provide a back massaging apparatus having a configuration capable of projecting a massaging member forward by s sufficient amount while intending to be thinned in the back and forth direction (thickness direction) and appropriately used for such as a chair-type massaging machine.

Solution to Problem

In order to accomplish the object mentioned above, the following technical means is taken in the present invention. A back massaging apparatus of the present invention is provided on a backrest part on which a user is allowed to take a backrest posture, and includes:

a massaging mechanism including: left and right paired massaging members each of which is provided with a treatment unit performing a massaging operation; and a drive unit transmitting a massaging operation to the massaging members; and a projection amount variable mechanism which moves said massaging members so that a projection amount in a back and forth direction of said treatment unit is varied, and in this configuration, a base portion of said massaging members is pivoted on a shaft core installed in a left and right direction and is made swingable about a shaft, and the projection amount variable mechanism is configured so as to swing said massaging members about the shaft core installed in the left and right direction via side portions of the base portion of said massaging members and render the projection amount in the back and forth direction of said treatment unit to be variable.

It is preferably configured that, said projection amount variable mechanism includes a crank shaft having one end portion coupled to a side portion of the base portion of the massaging members via a universal joint, and upon pushing and pulling said crank shaft, said massaging members are swung about the shaft core installed in the left and right direction.

In this configuration, the crank shaft is preferably curved so as not to be interfered with the base portion of said massaging members in the case where said treatment unit is activated so as to be moved backward.

The universal joint is preferably a ball joint, and said ball joint includes: a ball body provided in a state of projecting outward in a width direction from the side part of the base portion of the massaging members; and a jacket body provided on one end portion of said crank shaft and fitted to said ball body from the outside in the width direction.

It is preferable that, the massaging mechanism includes: a massaging drive unit driving said massaging members so as to move said treatment units closer to or separate away from each other in the left and right direction to thereby perform a massaging operation; and a tapping drive unit driving said massaging members so as to reciprocally move said treatment units in the back and forth direction or vertical direction by repeatedly swinging the base portion of said massaging members about the shaft to thereby perform a tapping massage operation, and said tapping drive unit is coupled with the other end portion of said crank shaft and said tapping drive unit is allowed to repeatedly push and pull said crank shaft.

It is preferable that, the massaging drive unit includes: a first rotating shaft installed in the left and right direction;

said massaging members provided so as to be relatively rotatable to the first rotating shaft; and a swing stopper mechanism regulating the massaging members from rotating together with the rotation of said first rotating shaft, and the swing stopper mechanism is configured to have one end portion of said crankshaft coupled to the side part of the base portion of the massaging members via the universal joint and the other end portion of said crank shaft coupled to the tapping drive unit.

It is preferable that, the massaging drive unit includes: the first rotating shaft installed in the left and right direction; said massaging members provided so as to be relatively rotatable to the first rotating shaft; and the swing stopper mechanism regulating the massaging members from rotating together with the rotation of said first rotating shaft, and the tapping drive unit is configured to be movable in the vertical direction on said base member, and upon vertical movement thereof, said crank shaft is configured to be push/pull movable, and said tapping drive unit includes: a second rotating shaft arranged in parallel with said first rotating shaft; and an eccentric drive unit provided in a state of the second rotating shaft being eccentric, and the eccentric drive unit is coupled with the other end portion of said crank shaft.

Advantageous Effects of Invention

According to the back massaging apparatus pertaining to the present invention, it is possible to project the massaging member forward by a sufficient amount while intending to be thinned in the back and forth direction (thickness direction) and the back massaging apparatus can be appropriately used for such as a chair-type massaging machine.

DESCRIPTION OF EMBODIMENTS

The following describes an embodiment of the present invention with reference to the drawings.

FIGS. 1 to 9 show one embodiment of a chair-type massaging machine with a back massaging apparatus pertaining to the present invention.

Figure 9:
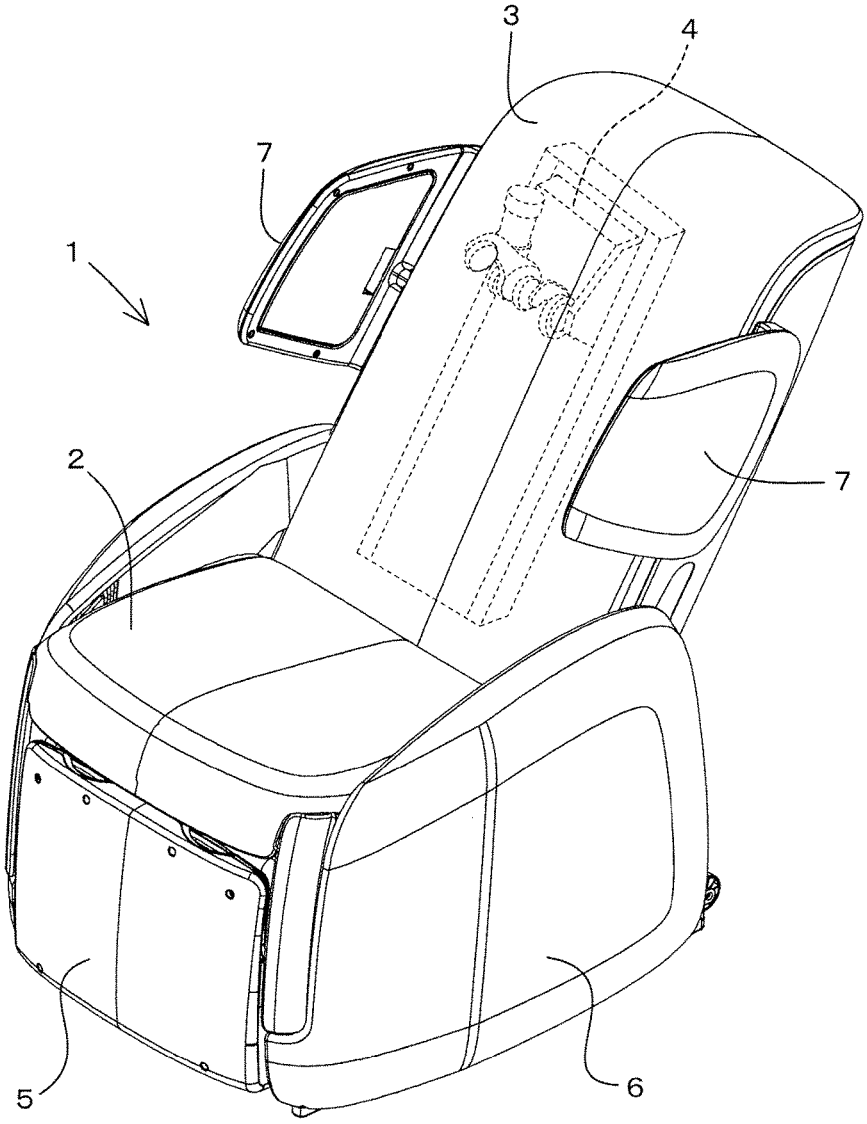
FIG. 9 is a perspective view showing a chair-type massaging machine provided with the back massaging apparatus pertaining to an embodiment of the present invention.

As shown in FIG. 9, this chair-type massaging machine 1 includes a seat part 2 having a sufficient area for supporting a lumbar region of a user from below and a backrest part 3 provided in a rear part of the seat part 2, and a back massaging apparatus 4 (a massaging apparatus for massaging or tap-massaging a shoulder region to back region to waist region of a user) is provided within the backrest part 3.

A leg frame 6 for installing this chair-type massaging machine 1 on a floor is provided under the seat part 2 and the seat part 2 is configured to be supported at a predetermined height by this leg frame 6.

Note that, in the following description, regarding the chair-type massaging machine 1 and the back massaging apparatus 4, a height direction of the backrest part 3 in a standing state is defined as a vertical direction and a left and right direction and a back and forth direction are determined on the basis of this to thereby describe a structure. This is coincident with the vertical direction, left and right direction and back and forth direction viewing from a user sitting on the chair-type massaging machine 1. In order to clarify a relationship between the directions in the drawings and the directions in the actual apparatus, the vertical direction (height direction), left and right direction (width direction) and back and forth direction used in the description of the present embodiment are clearly indicated in a representative drawing.

The lower end portion of the backrest part 3 is pivoted with respect to a rear part of the seat part 2 or a rear part of the leg frame 6 and held in a state of being freely swingable back and forth. This backrest part 3 can be act as a reclining by a reclining mechanism such as a linear actuator mechanism equipped within the leg frame 6. Further, it is configured that a leg massaging apparatus 5 is provided in a front part of the seat part 2 and armrest parts 7 are provided on both of the left and right sides of the seat part 2. However, these are merely one example of the equipment in the chair-type massaging machine 1 and presence or absence thereof and a fine mechanism thereof are not limited.

Figure 1:
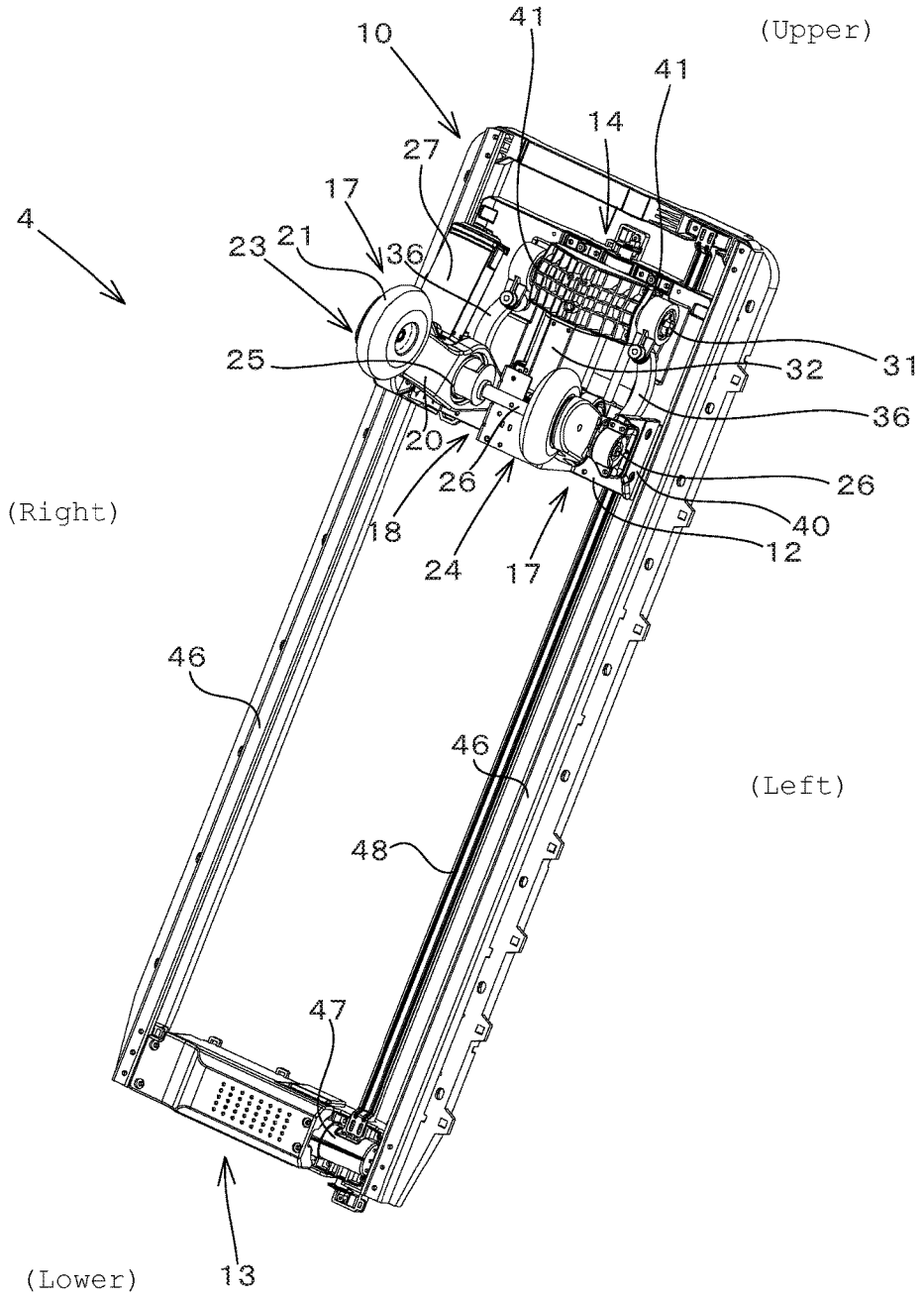
FIG. 1 is a perspective view of a back massaging apparatus pertaining to an embodiment of the present invention.
Figure 2:
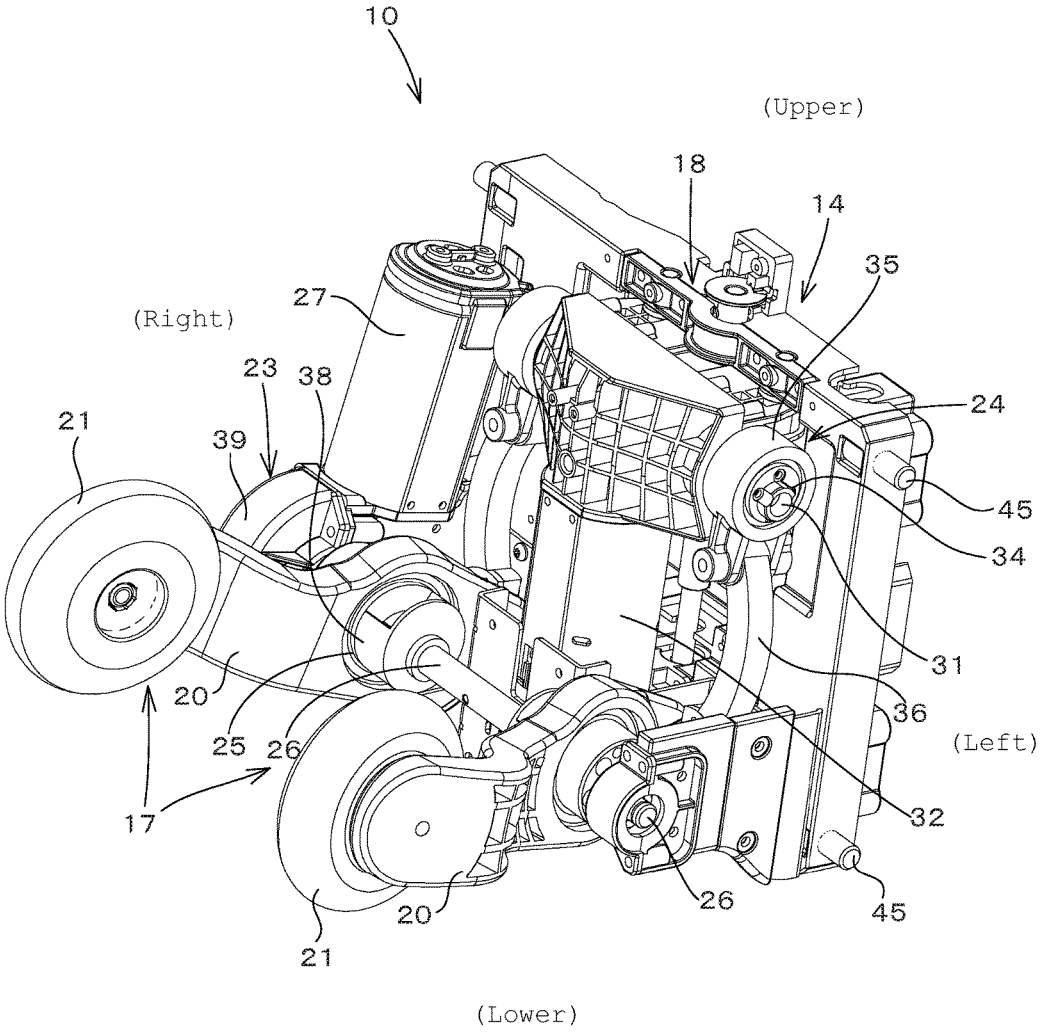
FIG. 2 is a perspective view of a massaging mechanism in a state that a treatment unit has advanced.
Figure 3:
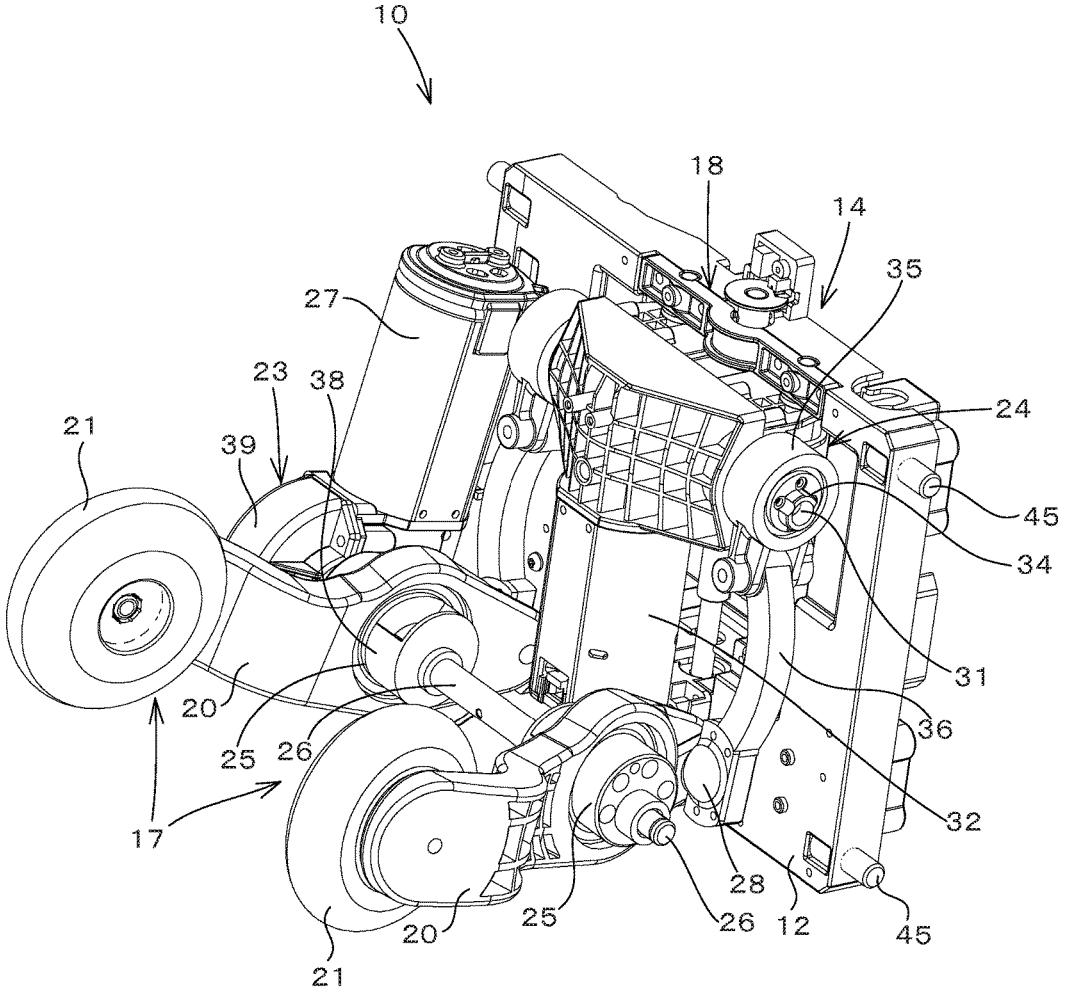
FIG. 3 is a perspective view of the massaging mechanism in a state that the treatment unit has advanced (bearing part is omitted).

As shown in FIG. 1, the back massaging apparatus 4 is provided with: a massaging mechanism 10; a base member 12 supporting this massaging mechanism 10; and a vertical movement mechanism 13 allowing this base member 12 to be movable in the vertical direction within the backrest part 3. In addition, this back massaging apparatus 4 includes a projection amount variable mechanism 14 which renders a supporting arm 20 to swing about a first rotating shaft 26 and vary a projection amount in the back and forth direction of the treatment unit 21 and move the massaging mechanism 10 back and forth with respect to the base member 12.

Figure 4:
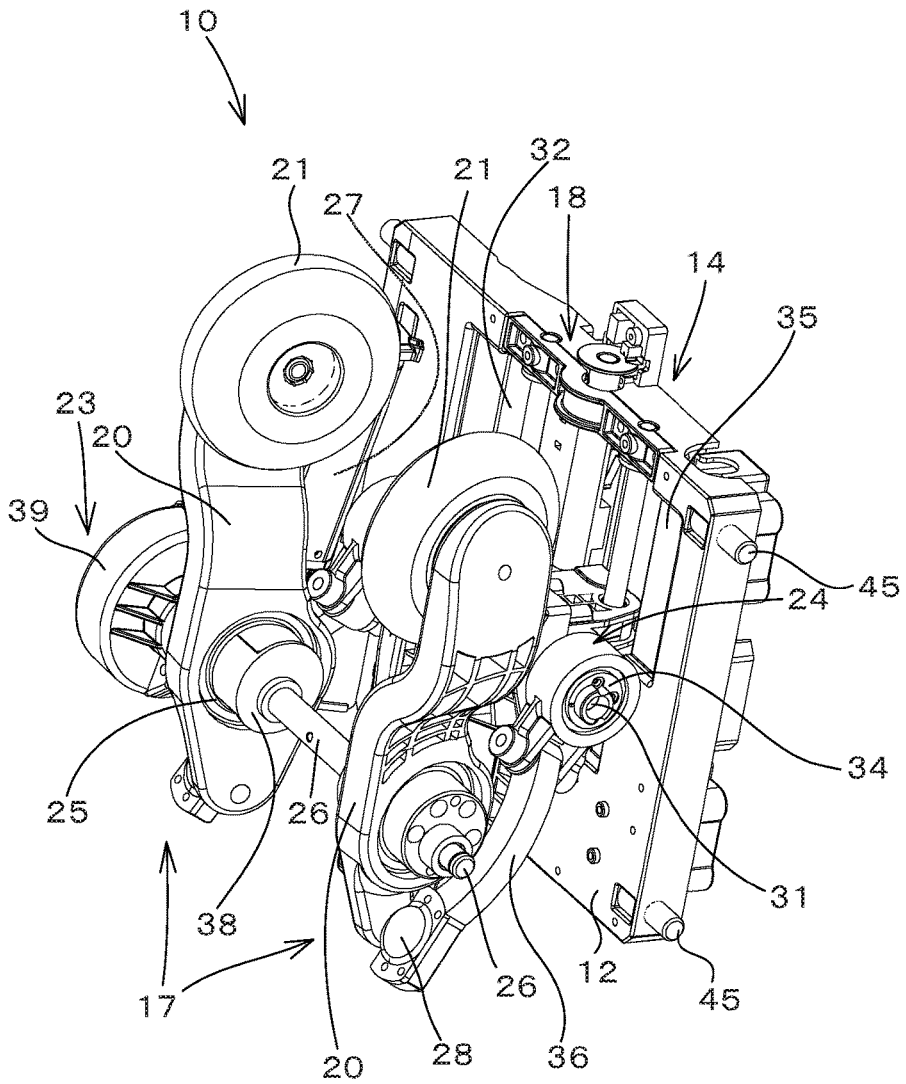
FIG. 4 is a perspective view of the massaging mechanism in a state that the treatment unit has retreated.
Figure 5:
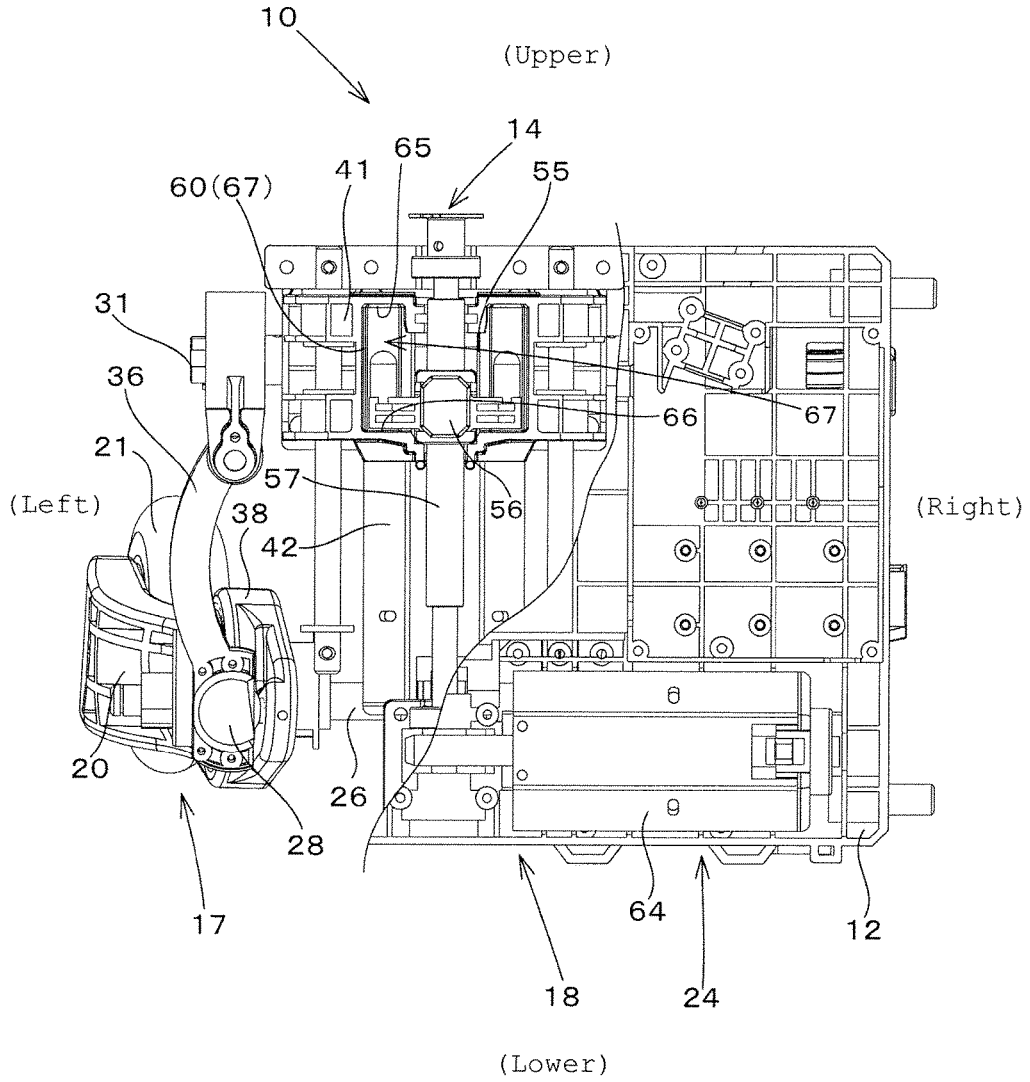
FIG. 5 is a rear view of the massaging mechanism in a state that the treatment unit has advanced.
Figure 8:
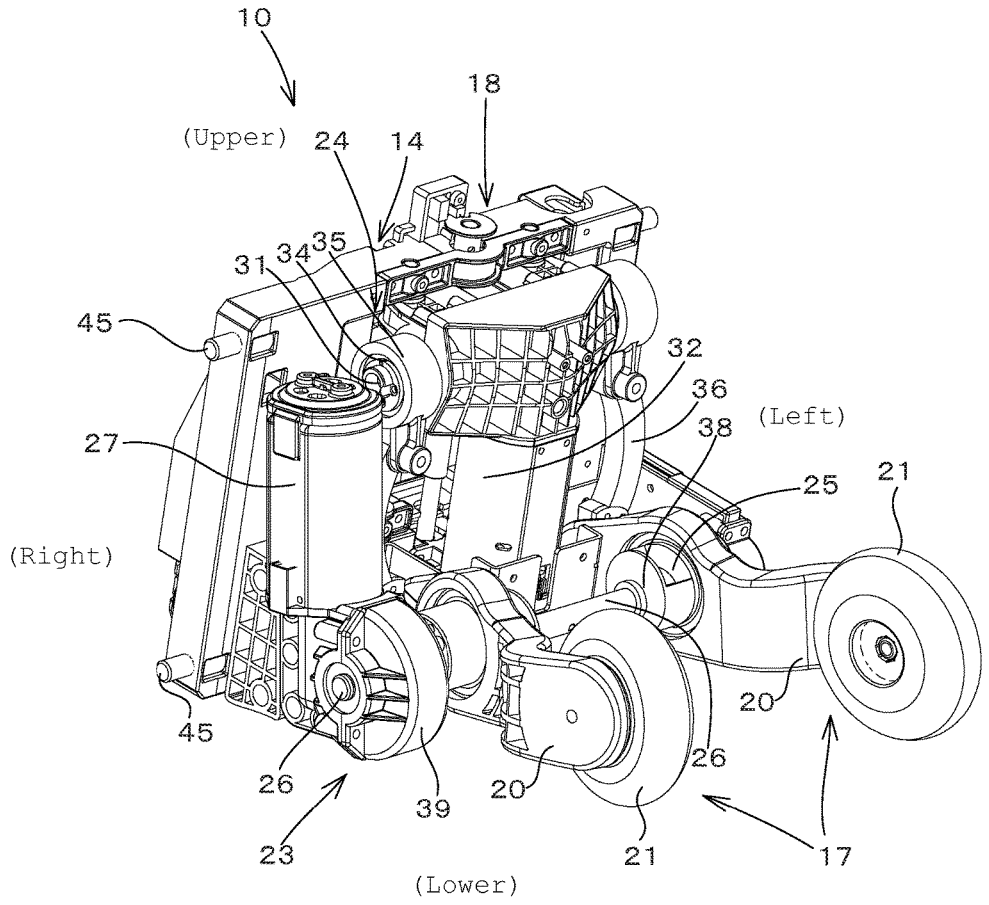
FIG. 8 is a perspective view (right perspective view) of the massaging mechanism in a state that the treatment unit has advanced.

First, based on FIG. 1 that is a perspective view of the back massaging apparatus 4, FIGS. 2 to 4, 7 and 8 which are perspective views of the massaging mechanism 10 viewing from a certain direction, FIG. 5 which is a rearview and FIG. 8 which is a perspective view viewing from a direction reverse to the certain direction, the massaging mechanism 10 is described.

The massaging mechanism 10 includes a pair of left and right massaging members 17 and a drive unit 18 rendering these left and right massaging members 17 to perform a massaging operation.

Each of the massaging members 17 includes a supporting arm 20 with its tip portion projected forward and a treatment unit 21 attached to the supporting arm 20. The treatment unit 21 can be formed to have such as a thick disk type or a spherical shape made of, for example, resin or hard rubber, etc. Note that, although the explanation is made about the left and right massaging members 17 each of which is provided with one treatment unit 21 in the following description, it may be also possible that a treatment unit of an upper end side is provided on the top end portion of the supporting arm 20 and a treatment unit of a lower end side is provided on the lower end portion thereof.

The drive unit 18 is configured to have a massaging drive unit 23 which renders the left and right massaging members 17 to perform an operation of moving close to or separating away from each other and a tapping drive unit 24 which renders the left and right massaging members 17 to perform an alternate tapping operation.

The massaging drive unit 23 includes: an inclined rotating member 25 provided in a state of being embedded in a middle curved portion with respect to the supporting arm 20 of each massaging member 17; a first rotating shaft 26 with its shaft core installed in the left and right direction so as to penetrate this inclined rotating member 25; and a massaging motor 27 for rotationally driving this first rotating shaft 26; and a swing stopper mechanism 28 which is provided on a rear portion of the middle curved portion in the supporting arm 20 and regulates the supporting arm 20 from being rotated together with a rotation of the first rotating shaft 26. As this swing stopper mechanism 28, there can be adopted a universal joint such as, for example, a bowl joint. A detailed connection structure between a crank shaft 36 (link lever) and the supporting arm 20 by the swing stopper mechanism 28 and a detailed structure of the crank shaft 36 are described later.

The inclined rotating member 25 is fixed to and held about an attachment boss part in a manner of freely rotatable via such as a bearing, the attachment boss part being provided concentrically and integrally with the first rotating shaft 26 so as to be rotatable in an inclined state. Therefore, in the case where the first rotating shaft 26 is rotated by driving the massaging motor 27, the inclined rotating member 25 comes to cause a fluctuation-like rotational blurring with the rotational center thereof as an axis and this rotational blurring is to be transmitted to the treatment unit 21 via the supporting arm 20.

Although the supporting arm 20 is held in a state that it is not co-rotated with the first rotating shaft 26 by the swing stopper mechanism 28, an operation within a predetermined range along the back and forth direction, left and right direction and vertical direction is tolerated. Further the inclination direction of the inclined rotating member 25 is held at a phase difference of 180° about the first rotating shaft 26 between the left and right supporting arms 20.

Thus, the left and right supporting arms 20 in the massaging drive unit 23 operate so that the treatment units 21 repeat coming close to each other and separating away from each other in the left and right direction, and generate a massaging operation serving as the massaging members 17. Note that, in the case where two pairs of treatment units are provided in the vertical direction, the upper paired treatment units are to be operated so as to repeat coming close to each other and separating away from each other in the left and right direction while the lower paired treatment units are to be operated so as to repeat separating away from each other and coming close to each other in the left and right direction. When the upper paired treatment units come close to each other, the lower paired treatment units separate away from each other, and when the upper paired treatment units separate away from each other, the lower paired treatment units come close to each other, and therefore this generates the massaging operation serving as the massaging members 17.

By the way, a position where the first rotating shaft 26 penetrates in the inclined rotating member 25 (a position of a through hole 70 where the first rotating shaft 26 penetrates) can be optionally set so as to be able to realize a desired movement of the left and right supporting arms 20 and treatment units 21.

Figure 10A:
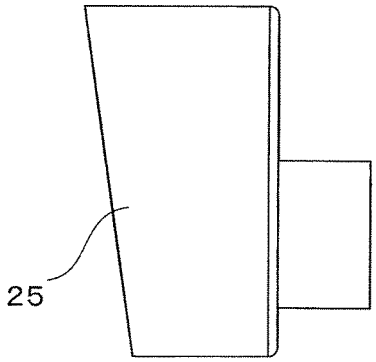
FIG. 10A and FIG. 10B show a relationship between an inclined rotating member and a first rotating shaft.
Figure 10B:
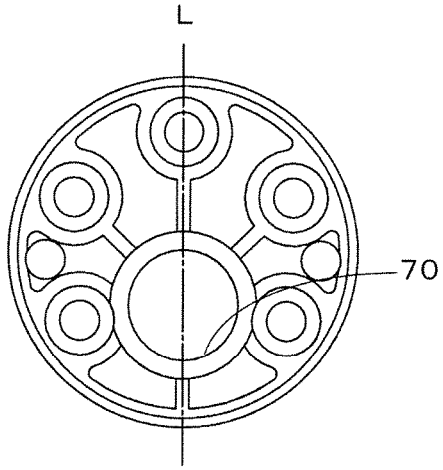

For example, as shown in FIG. 10A, by setting a position corresponding to a thinner portion in thickness of the inclined rotating member 25 on a line L shown in FIG. 10B connecting between the thickest portion and the thinnest portion in thickness direction of the inclined rotating member 25 so that the first rotating shaft 26 penetrates, after the paired treatment units 21 come close to each other, the paired treatment units 21 are moved to have the maximum projection at the time of separating away from each other and operate so as to press a treatment target region.

Figure 10C:
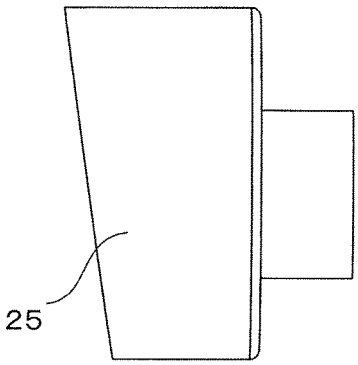
FIG. 10C and FIG. 10D show a relationship between the inclined rotating member and the first rotating shaft.
Figure 10D:
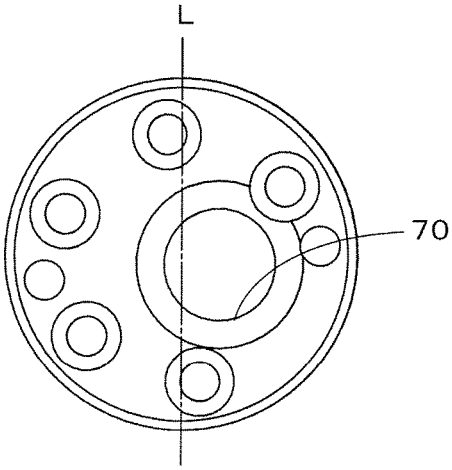

Further, as shown in FIG. 10C, by setting a position which is deviated in a circumferential direction of the inclined rotating member 25 from the line L shown in FIG. 10D connecting between the thickest portion and the thinnest portion in thickness direction of the inclined rotating member 25 so that the first rotating shaft 26 penetrates (so as to position the through hole 70), the paired treatment units 21 are most projected in a state that the paired treatment units 21 come closest to each other, thereby allowing to operate so as to be able to press a treatment target region.

Meanwhile, the tapping drive unit 24 includes: a second rotating shaft 31 provided with its shaft core oriented in the left and right direction so as to be in parallel with the first rotating shaft 26 in the upper position thereof; a tapping motor 32 for rotationally driving this second rotating shaft 31; left and right eccentric drive units 34 eccentrically provided at phase difference of 180° with respect to both left and right end portions of the second rotating shaft 31; and a crank shaft 36 provided to be projected downward with respect to a housing 35 which freely and rotatably holds the left and right eccentric drive units 34. That is, it is structured that the other end portion (upper end portion) of the crank shaft 3 is freely and rotatably coupled to the eccentric drive unit 34 about a shaft substantially perpendicular to the second rotating shaft 31.

The eccentric drive unit 34 is configured so that the shaft cores of the second rotating shaft 31 and the housing 35 are made to be in disalignment by mounting an eccentric collar to an inner wheel or an outer wheel of the bearing. Further, one end portion (lower end portion) of the crank shaft 36 is coupled to a middle curved portion of the supporting arm 20 having the massaging member 17, and this coupling portion is configured to form the swing stopper mechanism 28. That is, the swing stopper mechanism 28 is provided on the lower end portion of the crank shaft 36, and this results in that the base portion of the supporting arm 20 (massaging member 17) is coupled via the swing stopper mechanism 28.

Therefore, according this tapping drive unit 24, upon driving the tapping motor 32, the eccentric drive unit 34 is eccentrically rotated with respect to the shaft core of the second rotating shaft 31, and in response to this, the housing 35 becomes to circumferentially move. Therefore, a push/pull operation in the vertical direction is to be transmitted from this housing 35 to the crank shaft 36. Thus, the left and right supporting arms 20 cause the respective treatment units 21 to vibrate little by little each other about the first rotating shaft 26 and cause the treatment units to be moved in the back and forth direction, and therefore this results in generating a tapping operation serving as the massaging members 17.

Note that, since the left and right eccentric drive units 34 are provided with a phase difference of 180°, the swings caused in the left and right supporting arms 20 are to be alternately generated.

That is, when the left supporting arm 20 moves the treatment unit 21 forward, the right supporting arm 20 moves the treatment unit 21 rearward. Contrarily, when the left supporting arm 20 moves the treatment unit 21 forward, the right supporting arm 20 moves the treatment unit 21 rearward. Note that, in the case where two pairs of the treatment units are provided in the vertical direction, when the upper treatment unit is moved forward, the right supporting arm 20 moves the upper treatment unit rearward. Contrarily, when the left supporting arm 20 moves the lower treatment unit forward, the right supporting arm 20 moves the lower treatment unit rearward.

However, this is not a matter to be limited, and for example, upon providing a switching mechanism so as to set the phase difference zero between the left and right eccentric drive units 34, the setting of the tapping operation (tapping pattern) can be changed so that the left and right supporting arms 20 are synchronously swung toward the same direction.

Next, the following describes the base member 12 supporting the massaging mechanism 10 of the above configuration and the vertical movement mechanism 13 vertically moving this base member 12 within the backrest part 3.

The base member 12 supports the massaging mechanism 10 so that the massaging members 17 are directed forward. That is, the base member 12 is provided in the rear side of (behind) the massaging mechanism 10.

In specific, the middle portion of the first rotating shaft 26 bridging between the left and right massaging members 17 is rotatably supported by the first bearing part 38 and this first bearing part 38 is fixed to the base member 12. Further, a rightward projected portion of the first rotating shaft 26 penetrating the right massaging member 17 is coupled to the gear head 39 disposed on the base member 12, and the massaging motor 27 is coupled to this gear head 39. In addition, a leftward projected portion thereof penetrating the left massaging member 17 is rotatably held by a bearing bracket 40 which is fixed to a front surface of the base member 12.

Thus, since the first bearing part 38, the gear head 39 and the bearing bracket 40 serving as main parts in the massaging drive unit 23 are fixed to the base member 12, the massaging mechanism 10 as a whole is in a state of being supported by the base member 12.

Note that, although the second rotating shaft 31 of the tapping drive unit 24 is rotatably held by the second bearing part 41 disposed above the first bearing part 38 mentioned above, this second bearing part 41 is configured to be held so as to be vertically movable along a pair of left and right vertical rail parts 42 provided on the front surface of the base member 12. Further, the tapping motor 32 of the tapping drive unit 24 is disposed in the rear side (back side) of the second rotating shaft 31 to have a structure of being integrally coupled with the second bearing part 41 and is configured to be vertically moved on the base member 12 along with the vertical movement of this second bearing part 41.

Thus, even though the second bearing part 41 and the tapping motor 32 serving as the main parts of the tapping drive unit 24 are vertical movable, since the main parts (first bearing part 38, etc.) of the massaging drive unit 23 are fixed to the base member 12, the left and right massaging members 17 are never vertically moved with respect to the base member 12.

Since the second bearing part 41 of the tapping drive unit 24 and the second rotating shaft 31 supported by the same are vertically movable, the following movement can be realized. That is, both when the massaging motor 27 rotates the first rotating shaft 26 and when the tapping motor 32 rotates the second rotating shaft 31, the massaging members 17 are in principle restricted from co-rotating about the first rotating shaft 26 by the swing stopper mechanism 28.

However, in the case where a leaning load is loaded on the massaging members 17 by a user, a pushing and pulling force in the vertical direction is transmitted to the second rotating shaft 31 via the swing stopper mechanism 28 and the crank shaft 36, and this results in that the second bearing part and the tapping motor 32 vertically move along the vertical rail 42. Therefore, there is a motion that the massaging members 17 are tolerated to be rotated and swung about the first rotating shaft 26 as a rotation center in a predetermined range.

With this configuration, irrespective of a massaging operation by the massaging drive unit 23 or the tapping drive unit 24, the massaging members 17 are rotated about the first rotating shaft 26 in accordance with an undulation (S-character curve of a spine), and this results in that the treatment units 21 abut onto the back. It is possible to make switchable whether either one of the massaging drive unit 23 or the tapping drive unit 24 is activated or both of them are simultaneously operated.

The back massaging apparatus 4 is provided with a vertical movement mechanism 13 in order that the base member 12 is made to be movable in the vertical direction within the backrest part 3.

As shown in FIG. 1, the vertical movement mechanism 13 includes guide rollers 45 with their rotating shaft cores projected to the left and right outward direction and retained both in the left and right sides of the upper and lower portions of the base member 12. In addition, there are included a pair of left and right guide rails 46 for fitting these guide rollers 45 into the same and guiding the movement thereof in the vertical direction. Each of the guide rails 46 is incorporated within the backrest part 3 with its longitudinal direction vertically oriented.

Further, there are provided screw shafts 48 which are made to be rotationally drivable by an elevating motor 47, between both of the respective guide rails 46, and a nut member (not shown) to be screwed with each of these screw shafts 48 is built in the base member 12. Therefore, by rotationally driving the screw shafts 48 by activating the elevating motor 47, the massaging mechanism 10 is configured to be vertically moved within the backrest part 3 together with the base member 12.

Thus, a user sitting on the seat part 2 and pushing the back against the backrest part 3 can vertically move the massaging mechanism 10 and receive a massage in a wide range from a shoulder region to a back and lumbar region.

Next, the following describes "the projection amount variable mechanism 14" which is a characteristic mechanism of the back massaging apparatus 4 pertaining to the present invention.

The projection amount variable mechanism 14 is configured to swing the base portions of the massaging members 17 (the portions where the swing stopper mechanisms 28 are provided for the supporting arms 20) about the first rotating shaft 26 so as to vary the projection amount of the treatment units 21 in the back and forth direction. In other words, this projection amount variable mechanism 14 moves the tapping drive unit (second bearing part 41) in the vertical direction and pivotally swing the base portions of the massaging members 17 in accordance therewith.

The following describes the projection amount variable mechanism 14 in detail with reference to FIG. 5 and the like. Note that FIG. 5 is a rear view of the massaging mechanism 10 and a left side thereof shows a state of removing the base member 12.

First, the projection amount variable mechanism 14 includes: a guide body 55 provided in a middle portion in the width direction of the left and right massaging members 17 provided in a pair; a sliding body 56 provided within this guide body 55; and a feed screw shaft 57 vertically moving this sliding body 56 within the guide body 55.

The guide body 55 is fixedly arranged in the front surface side of the second bearing part 41 and the tapping motor 32 of the tapping drive unit 24 and is formed to have a longitudinal box shape (rectangular frame shape) with its front side opened. The front opened portion formed within this longitudinal box shape makes it possible to accommodate the sliding body 56 and forms a long groove 60 for guiding the accommodated sliding body 56 movably in the vertical direction.

In comparison to the guide body 55 like this, the sliding body 56 has a width size substantially equal to or slightly smaller than the groove width of the long groove 60 and it is formed to have a shorter size in the vertical direction than the long groove 60. Therefore, it becomes possible to relatively move vertically within the long groove 60 while retaining a state of causing no large rattling in the width direction within the long groove 60. Further, in this sliding body 56, there is formed a vertical hole penetrating between the upper surface and the lower surface thereof, and there is provided a female screw part 58 to be screwed with the feed screw shaft 57 in the inner surface of this hole.

The feed screw shaft 57 vertically penetrates within the hole of the sliding body 56 to be screwed with the female screw part 58 of the inner surface of the hole. On the upper end portion of this feed screw shaft 57, a worm wheel 62 is integrally and rotatably provided, and a worm gear 63 having its rotation shaft core perpendicular to this worm wheel 62 is engaged, and this worm gear 63 is configured so as to be rotationally driven by an electric motor 64.

That is, upon driving the electric motor 64, although the rotation drive is transmitted to the feed screw shaft 57 via the worm gear 63 and the worm wheel 62, the sliding body 56 is prevented from rotating about the feed screw shaft 57 due to preventing the rattling in the width direction within the long groove 60, and therefore there causes a relative screwing action between the feed screw shaft 57 and the sliding body 56, and this results in that the sliding body 56 vertically moves within the long groove 60.

In the projection amount variable mechanism 14 having a configuration like this, by rotationally driving the feed screw shaft 57 to any one direction by the electric motor 64 as described above, the sliding body 56 moves upward or moves downward.

Note that, in the guide body 55, the upper edge of the long groove 60 is an upper limit when the sliding body 56 moves upward within the long groove 60. When the sliding body 56 continues moving upward after the sliding body 56 abuts to this upper edge, an upward movement force is transmitted from the sliding body 56 to the whole part of the guide body 55, and not only the guide body 55 moves upward, but also the second bearing part 41 and the tapping motor 32 of the tapping drive unit 24 integrally formed with the guide body 55 become to move upward while being guided by the vertical rail part 42.

That is, when the second bearing part 41 arrives at the upper limit of the vertical rail part 42, also the sliding body 56 abutting to the upper edge of the long groove 60 is restrained from moving upward any more within the guide body 55, and therefore the upper edge of the long groove 60 at this time is defined as a first regulation section 65.

Further, the lower edge of the long groove 60 is a lower limit when the sliding body 56 moves downward within the long groove 60. When the sliding body 56 continues moving downward after the sliding body 56 abuts to this lower edge, a downward movement force is transmitted from the sliding body 56 to the whole part of the guide body 55, and not only the guide body 55 moves downward, but also the second bearing part 41 and the tapping motor 32 of the tapping drive unit 24 integrally formed with the guide body 55 become to move downward while being guided by the vertical rail part 42.

That is, when the second bearing part 41 arrives at the lower limit of the vertical rail part 42, also the sliding body 56 abutting to the lower edge of the long groove 60 is restrained from moving downward any more within the guide body 55, and therefore the lower edge of the long groove 60 at this time is defined as a second regulation section 66.

Further, in a state that the second bearing part 41 neither arrives at the upper limit nor the lower limit of the vertical rail part 42, the downward movement of the guide body 55 to the sliding body 56 is allowed till the sliding body 56 and the lower edge of the long groove 60 are abutted, and the upward movement of the guide body 55 to the sliding body 56 is allowed till the sliding body 56 and the upper edge of the long groove 60 are abutted. That is, since the guide body 55 is vertically movable in a predetermined range, there is formed a non-regulation section 67 within the long groove 60 (a region in the vertical direction between the first regulation section 65 and the second regulation section 66 within the long groove 60) under this condition.

In the projection amount variable mechanism 14 having the configuration as described above, in the case where the sliding body 56 is moved downward, the sliding body 56 abuts to the lower edge within the long groove 60 and transmits a downward movement force to the guide body 55 and the guide body 55 is to be moved downward while being guided by the vertical rail part 42 together with the second bearing part 41 and the tapping motor 32 of the tapping drive unit 24. The downward movement of the second bearing part 41 and the tapping motor 32 renders the base portion of the massaging members 17 to be swung downward about the first rotating shaft 26 via the crank shaft 36 (rotate in a clockwise direction with the first rotating shaft 26 as a rotation center in FIG. 2) as described above, and this results in that the treatment units 21 are moved backward. When the sliding body 56 arrives at the first regulation section 65 (upper edge of the long groove 60) to be engaged and does not move upward any more, a swing angle of each of the massaging members 17 is to be retained in a state that the treatment units 21 are moved most backward. Even though the treatment units 21 are tried to be pulled out by a pulling force of a user, it becomes a situation that the treatment units 21 cannot be pulled out.

Contrarily, in the case where the sliding body 56 is moved upward, the sliding body 56 abuts to the upper edge within the long groove 60 and transmits a upward movement force to the guide body 55 and the guide body 55 is to be moved upward while being guided by the vertical rail part 42 together with the second bearing part 41 and the tapping motor 32 of the tapping drive unit 24. The upward movement of the second bearing part 41 and the tapping motor 32 renders the base portion of the massaging members 17 to be swung upward about the first rotating shaft 26 via the crank shaft 36 (rotate in a counterclockwise direction with the first rotating shaft 26 as a rotation center in FIG. 2), and this results in that the treatment units 21 are projected forward. When the sliding body 56 arrives at the first regulation section 65 (upper edge of the long groove 60) to be engaged and does not move upward any more, a swing angle of each of the massaging members 17 is to be retained in a state that the treatment units 21 are projected most forward. Even though the treatment units 21 are tried to be pushed in by a pushing force of a user, it becomes a situation that the treatment units 21 cannot be pushed in.

On the other hand, while the sliding body 56 exists in the non-regulation section 67, the guide body 55 is vertically movable by a vertical length of the non-regulation section 67. Therefore, the second bearing part 41 and the tapping motor 32 of the tapping drive unit 24 are also vertically movable by the vertical length of the non-regulation section 67 while being guided by the vertical rail part 42.

Therefore, such a vertical movement of the guide body 55 is transmitted to the crankshaft 36 and the base portion of the massaging members 17 becomes swingable about the first rotating shaft 26. That is, since the rotation of the massaging members 17 (rotation about the first rotating shaft 26) is allowed except in a posture of the massaging members 17 regulated by the first regulation section 65 and the second regulation section 66, there can be obtained a situation that the treatment unit 21 can freely perform the forward projection and backward movement, as a result.

In this projection amount variable mechanism 14, the lower end portion of the crank shaft 36 and the supporting arm 20 are connected via a universal joint such as a ball joint functioning as the swing stopper mechanism 28 mentioned above.

As shown in FIG. 4, the crank shaft 36 is curved outward in the width direction so as not to interfere with the base portion of the supporting arm 20 (each of the massaging members 17) in the case where the treatment unit 21 is activated to be retreated (accommodated) in the upward side. Moreover, as shown in an enlarged view of FIG. 7, the ball joint functioning as the swing stopper mechanism includes: a ball body 28B provided in a shape of projecting outward in the width direction from the side portion of the base portion of the supporting arm 20; and a jacket body 28A fitted into the ball body 28B provided in the lower end portion of the crank shaft 36 from the outside in the width direction.

In this way, the crank shaft 36 is curved and the ball body 28B of the ball joint is projected sideward from the crankshaft 36 to thereby freely connect between the crank shaft 36 and the supporting arm 20, and therefore, in the case where a position of the treatment unit 21 is moved by the projection amount variable mechanism 14 the interference between the crank shaft 36 and the base portion of the supporting arm 20 can be suppressed to be minimum, and this results in that a movable range with respect to the position of the treatment unit 21 can be extended by the projection amount variable mechanism 14.

Figure 6A:
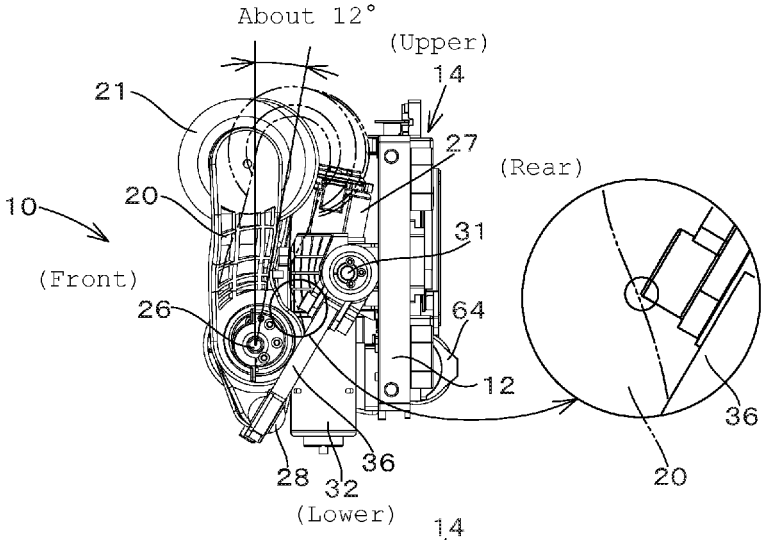
FIG. 6A is a side view of the massaging mechanism showing a state that the treatment unit moves from a retreating position to an advancing position and the treatment unit exists in the retreating position in this figure.
Figure 6B:
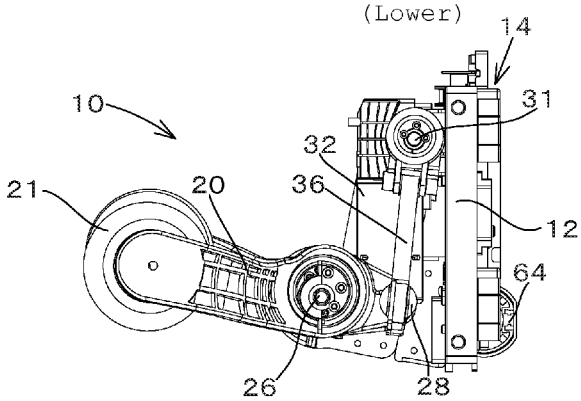
FIG. 6B is a side view of the massaging mechanism showing a state that the treatment unit moves from the retreating position to the advancing position and the treatment unit exists in the advancing position in this figure.
Figure 6C:
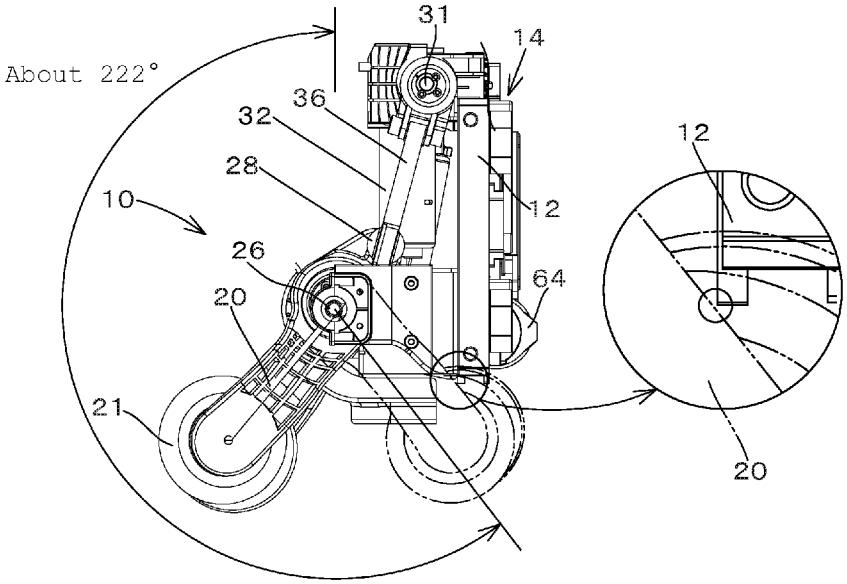
FIG. 6C is a side view of the massaging mechanism showing a state that the treatment unit moves from the retreating position to the advancing position and the treatment unit exists in the advancing downward position in this figure.
Figure 7:
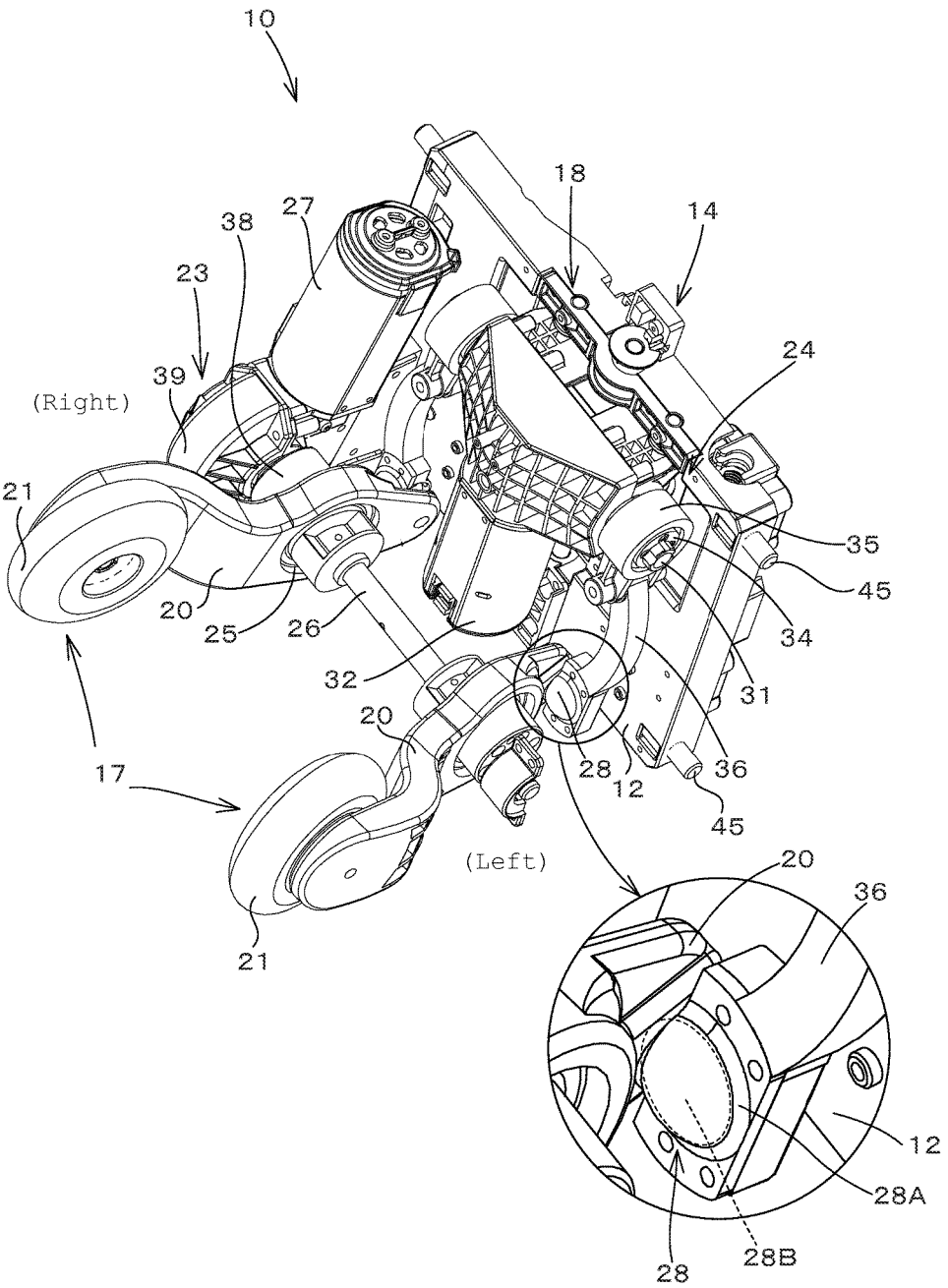
FIG. 7 is a perspective view (left perspective view) of the massaging mechanism in a state that the treatment unit has advanced.

FIGS. 6A to 6C are views in the case where the crank shaft 36 is curved and the ball body 28B of the ball joint is projected sideward from the crank shaft 36 to thereby freely connect between the crank shaft 36 and the supporting arm 20, from a state that the projection amount variable mechanism 14 is activated and the treatment unit 21 is most retreated in the upward side (shown by two-dotted chain line in FIG. 6A) to be moved to a state that the treatment unit 21 is most retreated in the downward side (shown by two-dotted chain line in FIG. 6C) via a state that the treatment unit 21 is most projected forward (shown in FIG. 6B). Note that the case of showing by the two-dotted chain line in FIG. 6A can be also referred to as an accommodation state.

FIG. 6A shows a state that the tapping drive unit 24 (second bearing part 41) is moved downward to push the crank shaft 36 and the base portion of the massaging member 17 is swung downward about the first rotating shaft 26. In FIG. 6A, the base portion of the supporting arm 20 in an upright state of the supporting arm 20 is shown by a solid line and the base portion of the supporting arm 20 in the most retreated state in the upward side is shown by a two-dotted chain line.

In the case where the crank shaft 36 is not curved outward like a comparative article (for example, a back massaging apparatus described in Japanese Patent Application No. 2011-28305), a position where the crank shaft 36 abuts to (begins to interfere with) the base portion of the supporting arm 20 is the limit of most retreating the treatment unit 21 in the upward side. This position is located frontward by about 14.5° than the upright state of the supporting arm 20 shown by the solid line.

On the other hand, in the present embodiment, in the case where the crank shaft 36 is curved as shown by the two-dotted chain line, the position where the base portion of the supporting arm 20 abuts to (begins to interfere with) the member in a side of the second rotating shaft 31 of the crank shaft 36 without the crank shaft 36 abutting to (interfering with) the base portion of the supporting arm 20 is the limit of most retreating the treatment unit 21 in the upward side. This position is located rearward by about 12° than the upright state of the supporting arm 20 shown by the solid line.

At this time, as shown in FIG. 4, the treatment unit 21 is retreated so that the base portion of the supporting arm 20 is fitted to the curved portion of the crank shaft 36, and in comparison to the case where the crank shaft 36 is not curved as in the comparative article, the retreat angle of the treatment unit 21 can be made large.

In addition to this, instead of projecting the ball body of the ball joint forward from the crank shaft 36 to thereby freely connect between the crank shaft 36 and the supporting arm 20 as in the comparative article, by projecting the ball body of the ball joint sideward from the crank shaft 36 to thereby freely connect between the crank shaft 36 and the supporting arm 20 as in the present embodiment, the movable angle of the treatment unit 21 can be made large.

In FIG. 6C, the base portion of the supporting arm 20 in the state of being most retreated in the downward side in the case of projecting the ball body of the ball joint sideward from the crank shaft 36 to thereby freely connect between the crank shaft 36 and the supporting arm 20 is shown by the two-dotted chain line. That is, FIG. 6C shows a state that the tapping drive unit 24 (second bearing part 41) is moved upward to thereby pull the crank shaft 36 and the base portion of the massaging member 17 is swung upward about the first rotating shaft 26.

In the case of projecting the ball body of the ball joint forward from the crank shaft 36 to thereby freely connect between the crank shaft 36 and the supporting arm 20 as in the comparative article, the position where the crank shaft 36 abuts to (begins to interfere with) the base portion of the supporting arm 20 is the limit of most retreating the treatment unit 21 in the downward side. This position is located frontward by about 80.5° than the upright state of the supporting arm 20 shown by the solid line in FIG. 6A.

On the other hand, in the case of projecting the ball body of the ball joint sideward from the crank shaft 36 to thereby freely connect between the crank shaft 36 and the supporting arm 20 as shown by the two-dotted chain line in the present embodiment, the position where the base portion of the supporting arm 20 abuts to (begins to interfere with) the base member 12 without the crank shaft 36 abutting to (interfering with) the base portion of the supporting arm 20 is the limit of most retreating the treatment unit 21 in the downward side. This position is located frontward by about 222° (i.e., rearward by about 42° in the lower side) than the upright state of the supporting arm 20 shown by the solid line.

Thus, in the comparative article where the ball body of the ball joint is projected forward from the crank shaft 36 to thereby freely connect between the crank shaft 36 and the supporting arm 20 without curving the crank shaft, the rotating range of the base portion of the supporting arm 20 is about 66° in total, ranging from about 14.5° frontward to about 80.5° frontward than the upright state of the supporting arm 20. On the other hand, in the present embodiment where the ball body of the ball joint is projected sideward from the crank shaft 36 to thereby freely connect between the crank shaft 36 and the supporting arm 20 while the crank shaft is curved, the rotating range of the base portion of the supporting arm 20 is about 234° in total, ranging from about 12° rearward than the upright state of the supporting arm 20 as shown by the two-dotted line in FIG. 6A to about 222° frontward than the upright state of the supporting arm 20 as shown by the two-dotted line in FIG. 6C.

Thus, the rotating range of the base portion of the supporting arm 20 (massaging member 17) is largely extended from about 66° to about 234°. In this largely extended range, the position in the back and forth direction of the treatment unit 21 is to be set by the projection amount variable mechanism 14 so as to have a movement amount in the back and forth direction appropriate for a massage target (lumbar region, shoulder region). In practical use, the supporting arm 20 is fixed to any position (for example, the position shown in FIG. 6B) between the accommodating position in the upright state of the base portion of the supporting arm 20 shown by the solid line in FIG. 6A and the position of the base portion of the supporting arm 20 shown by the solid line in FIG. 6C, and the position of the treatment unit 21 is set with an appropriate movement amount for a massage target (such as a lumbar region or a shoulder region).

As described above, in the back massaging apparatus of the present embodiment, the treatment unit 21 can be situated in a state of being projected downward and frontward without causing an interference between the mutual members as shown by the solid line in FIG. 6C. By locating the treatment unit 21 at this, position, it becomes possible to appropriately massage such as a lumbar region of a user. Further, as shown in FIG. 6B, the treatment unit 21 can be situated in a state of being projected forward. By locating the treatment unit 21 at this position, it becomes possible to appropriately massage a wide range from a lumbar region to a back region and shoulder region of a user. As shown in FIG. 6A, by orienting the treatment unit 21 upward, the accommodating state of the treatment unit 21 can be realized.

As apparent from the above detailed description, since the back massaging apparatus 4 pertaining to the present invention has a configuration equipped with the projection amount variable mechanism 14 instead of an extrusion/retraction operating mechanism equipped in the conventional back massaging apparatus (see, e.g., Patent Literature 1), a rail part and a swing regulation mechanism having a structure of projecting forward become unnecessary, and the thickness in the back and forth direction as the back massaging apparatus 4 can be thinned. Further, even though the back massaging apparatus 4 is thinned in this way, a movement amount for projecting the massaging mechanism 10 forward or returning back the same to the original normal position can be sufficiently secured.

Naturally, since it is possible to reduce the size in thickness of the back massaging apparatus 4, the backrest part 3 as the chair-type massaging machine 1 can be suppressed from increasing in thickness.

Moreover, in this chair-type massaging machine 1, by leaning against the backrest part 3 so as to push the back thereto by a user sitting on the seat part 2 and activating the back massaging apparatus 4 in the same state, a massage by the massaging drive unit 23 and a tapping massage by the tapping drive unit 24 of the massaging mechanism 10 can be received via the left and right massaging members 17.

Then, by activating the projection amount variable mechanism 14 in accordance with a requirement as to a body type of a user or a massaging position or a favorite of a user, the massaging mechanism 10 (massaging members 17) can be projected forward than the normal massaging position or returned back to an original normal position.

Therefore, it becomes in a state that a massage such as tapping and massaging operation can be accurately and locally (at a pinpoint) obtained and expectations of a user can be satisfied.

By the way, it should be considered that the embodiments disclosed this time are exemplified in all viewpoints and not limited ones. The scope of the present invention is shown by a range of claims but not by the explanation described above, and it is intended that the changes and modifications within the range of claims and range of equivalent meanings thereof are all included.

For example, a detail structure (other than the fundamental configuration equipped with the seat part 2 and the backrest part 3) as the chair-type massaging machine 1 and a detail structure of the massaging mechanism 10 and the like should not be limited at all.

Further, although the massaging members 17 described in the embodiment are "two-balls type" provided with left and right treatment units 21 one by one, respectively, there is no problem even though the massaging members 17 are "four-balls type" that includes a boomerang typed supporting arm with its tip end portions diagonally forward of upward and downward and the treatment units provided at both upper and lower end portions of this supporting arm as described in the embodiment.

REFERENCE SIGNS LIST

1 . . . Chair-type massaging machine
2 . . . Seat part
3 . . . Backrest part
4 . . . Back massaging apparatus
5 . . . Leg massaging apparatus
6 . . . Leg frame
7 . . . Armrest part
10 . . . Massaging mechanism
11 . . . Swing pivot part
12 . . . Base member
13 . . . Vertical movement mechanism
14 . . . Projection amount variable mechanism
17 . . . Massaging member
18 . . . Drive unit
20 . . . Supporting arm
21 . . . Treatment unit
23 . . . Massaging drive unit
24 . . . Tapping drive unit
25 . . . Inclined rotating member
26 . . . First rotating shaft
27 . . . Massaging motor
28 . . . Swing stopper mechanism
31 . . . Second rotating shaft
32 . . . Tapping motor
34 . . . Eccentric drive unit
35 . . . Housing
36 . . . Crank shaft
38 . . . First bearing part
39 . . . Gear head
40 . . . Bearing bracket
41 . . . Second bearing part
42 . . . Vertical rail part
45 . . . Guide roller
46 . . . Guide rail
47 . . . Elevating motor
48 . . . Screw shaft
55 . . . Guide body
56 . . . Sliding body
57 . . . Feed screw shaft
58 . . . Female screw part
60 . . . Long groove
62 . . . Worm wheel
63 . . . Worm gear
64 . . . Electric motor
65 . . . First regulation section
66 . . . Second regulation section
67 . . . Non-regulation section

The invention claimed is:

1. A back massaging apparatus provided on a backrest part on which a user is allowed to take a backrest posture, comprising:

a massaging mechanism including:

left and right paired massaging members, each massaging member provided with a treatment unit performing a massaging operation;

a drive unit transmitting a massaging operation to the massaging members;

a massaging motor for rotationally driving a first rotating shaft installed in a left and right direction; and a base portion of the massaging members pivoted on the first shaft; and a projection amount variable mechanism which moves said massaging members so that a projection amount in a back and forth direction of said treatment unit is varied, the back and forth direction being perpendicular to the left and right direction, wherein said projection amount variable mechanism is configured so as to swing said massaging members about the first shaft via side portions of the base portion of said massaging members and render the projection amount in the back and forth direction of said treatment unit to be variable, wherein said projection amount variable mechanism includes a crank shaft having a first end portion coupled to the side portions of the base portions of the massaging members via a universal joint, and wherein upon pushing and pulling of said crank shaft, said massaging members are configured so as to be swung about the first shaft.

2. The back massaging apparatus according to claim 1, wherein said crank shaft is curved so as not to be interfered with the base portion of said massaging members in a case where said treatment unit is activated so as to be moved backward.

3. The back massaging apparatus according to claim 1, wherein said universal joint is a ball joint, and said ball joint includes:

a ball body provided in a state of projecting outward in a width direction from the side portions of the base portions of the massaging members; and a jacket body provided on one end portion of said crank shaft and fitted to said ball body from an outside in the width direction.

4. The back massaging apparatus according to claim 3, wherein the drive unit of the massaging mechanism includes:

a massaging drive unit driving said massaging members so as to move said treatment units closer to or separate away from each other in the left and right direction to thereby perform a massaging operation; and a tapping drive unit driving said massaging members so as to reciprocally move said treatment units in the back and forth direction or in a vertical direction by repeatedly swinging the base portion of said massaging members about the first shaft to thereby perform a tapping massage operation, wherein said tapping drive unit is coupled with a second end portion of said crank shaft and said tapping drive unit is allowed to repeatedly push and pull said crank shaft.

5. The back massaging apparatus according to claim 4, further comprising a swing stopper mechanism regulating the massaging members from rotating together with the rotation of said first shaft, wherein said swing stopper mechanism is configured to have the first end portion of said crank shaft coupled to the side portion of the base portion of the massaging members via the universal joint and the second end portion of said crank shaft coupled to the tapping drive unit.

6. The back massaging apparatus according to claim 5, wherein said tapping drive unit is configured to be movable in the vertical direction on said base member, and upon vertical movement thereof, said crank shaft is configured to be push/pull movable, and said tapping drive unit includes: a second rotating shaft arranged in parallel with said first rotating shaft; and an eccentric drive unit provided in a state of the second rotating shaft being eccentric, and wherein said eccentric drive unit is coupled with the other end portion of said crank shaft.

* * * * *